US005507163A

United States Patent [19]

Juang

[11] Patent Number: 5,507,163

[45] Date of Patent: Apr. 16, 1996

[54] INTERCHANGEABLE LOCK CORE STRUCTURE

[76] Inventor: Wen-Jang Juang, No. 62, Hoshan St., Tainan City, Taiwan

[21] Appl. No.: 222,429

[22] Filed: Apr. 4, 1994

[51] Int. Cl.[6] ..... E05B 27/04

[52] U.S. Cl. ..... 70/369; 70/373

[58] Field of Search ..... 70/367–371, 386, 70/340, 364, 357, 348, 344, 336, 337, 338, 373, 365, 367

[56] References Cited

U.S. PATENT DOCUMENTS

| | | | |
|---|---|---|---|
| 1,417,132 | 5/1922 | Barker | 70/386 |
| 2,814,941 | 12/1957 | Best | 70/340 |
| 3,464,243 | 9/1969 | Hawkins | 70/364 |
| 4,386,510 | 6/1983 | Best et al. | 70/369 |

*Primary Examiner*—Steven N. Meyers
*Assistant Examiner*—Tuyet-Phiuong Pham
*Attorney, Agent, or Firm*—Hedman, Gibson & Costigan

[57] ABSTRACT

An interchangeable lock core includes a main body, an operative ring, and a core body. The main body includes upper and lower sections, the upper section having two sides and a plurality of first holes each for receiving a driver and a spring therein, and the lower section having a first bore extending in a longitudinal axis thereof and a transverse reception hole in a mediate section thereof. The reception hole extends upwardly into the upper section and defines first and second operative edges respectively at two sides of the upper section. A blind hole is defined in the upper section and communicates with the reception hole for receiving a second spring and a ball therein. The operative ring is received in the reception hole of the lower section of the main body and includes a second bore in alignment with the first bore and an extension which projects outwardly from an outer periphery thereof and extends along an arc thereof. The extension has first and second catches at two sides thereof and a dimple defined in an upper face thereof. At least one second hole is defined in the extension, and aligns with an associated first hole in the upper section of the main body, and communicates with the second bore of the ring. The core body is received in the first bore of the main body and the second bore of the operative ring and includes a keyway and a plurality of third holes each aligning with an associated first hole.

1 Claim, 7 Drawing Sheets

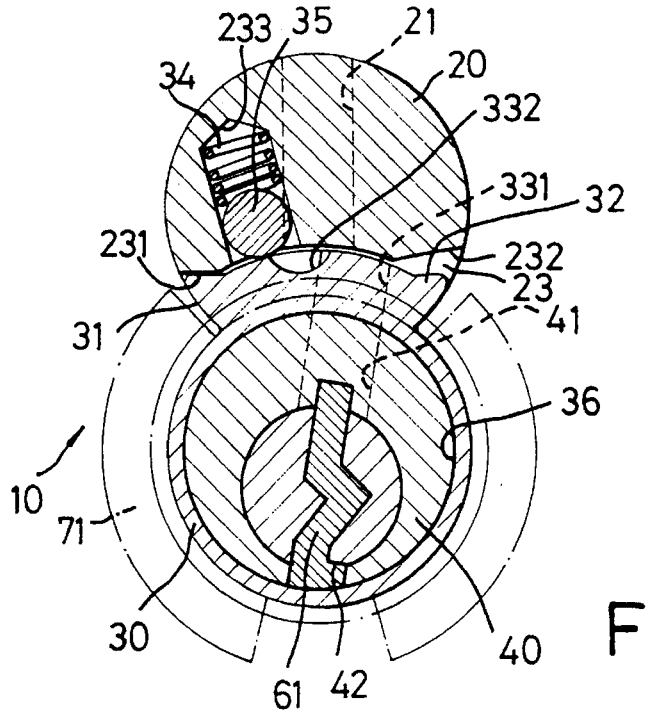
FIG.6
FIG.9
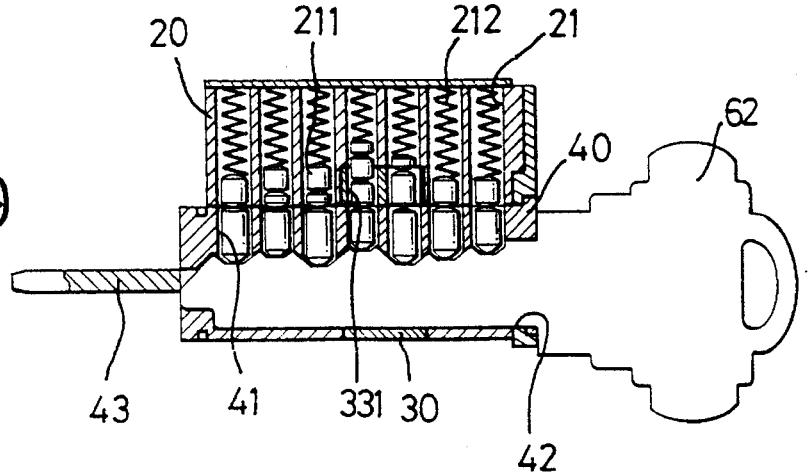
FIG.10
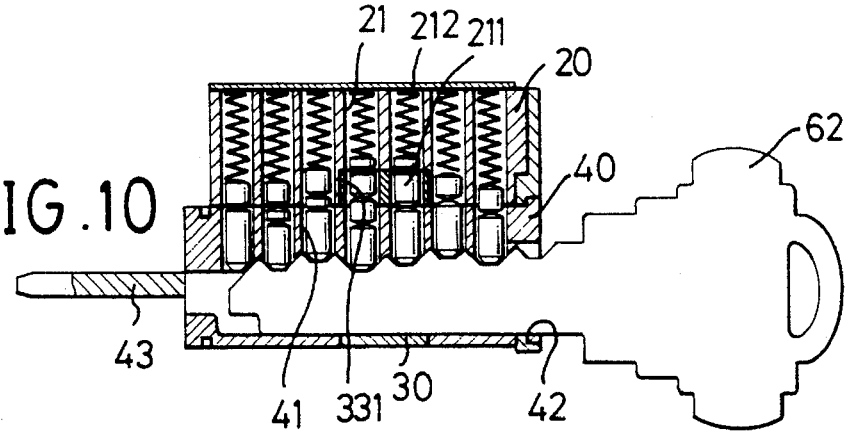

INTERCHANGEABLE LOCK CORE STRUCTURE

BACKGROUND OF THE INVENTION

1. Field of the Invention

The present invention relates to an improved interchangeable lock core structure which is substantially "8" shaped in section.

2. Description of Related Art

Interchangeable lock cores are useful in public locations to avoid intrusion by unauthorized persons. Taking a hotel room as an example, the core of the door lock of the room is replaced with another one soon after the guest has checked out such that said guest cannot use the key of the previous lock to enter the room without authorization. Although conventional lock cores may have numerous combinations to satisfy the need of avoiding unauthorized entrance mentioned in the above, it is, however, found that they still have several drawbacks, such as high manufacturing costs and troublesome machining due to the complicated structure thereof. The present invention is intended to provide an improved design in this regard.

SUMMARY OF THE INVENTION

An interchangeable lock core provided by the present invention includes a main body, an operative ring, and a core body. The main body includes upper and lower sections, the upper section having two sides and a plurality of first holes each for receiving a driver and a spring therein, and the lower section having a first bore extending in a longitudinal axis thereof and a transverse reception hole in a mediate section thereof. The reception hole extends upwardly into the upper section and defines first and second operative edges respectively at two sides of the upper section. A blind hole is defined in the upper section and communicates with the reception hole for receiving a second spring and a ball therein.

The operative ring is received in the reception hole of the lower section of the main body and includes a second bore in alignment with the first bore and an extension which projects outwardly from an outer periphery thereof and extends along an arc thereof. The extension has first and second catches respectively at two sides thereof and a dimple defined in an upper face thereof. At least one second hole is defined in the extension, and aligns with an associated first hole in the upper section of the main body, and communicates with the second bore of the ring.

The core body is received in the first bore of the main body and the second bore of the operative ring and includes a keyway and a plurality of third holes each aligning with an associated first hole.

When a control key is inserted into the keyway, the operative ring is pivotable between (i) a first position in which the ball is partially received in the dimple under the action of spring force, the second catch bears against the second operative edge, and the first catch is in a position beyond the main body for unlocking under operation of an operation key when the lock core is mounted in an exterior lock housing and (ii) a second position in which the ball disengages with said dimple and the first catch is in a position in the reception hole and bears against the first operative edge such that the lock core is mountable to the exterior lock housing or removable therefrom.

Other objects, advantages, and novel features of the invention will become more apparent from the following detailed description when taken in conjunction with the accompanying drawings.

BRIEF DESCRIPTION OF THE DRAWINGS

FIG. 6 is a cross-sectional view taken along line 6—6 in FIG. 5, a retainer being added in phantom lines for illustration purpose;

FIG. 9 is a cross-sectional view of the lock core in cooperation with a dual function key which is in a position for unlocking;

FIG. 10 is a cross-sectional view of the lock core in cooperation with a dual function key which is in another position for removing the lock core;

DESCRIPTION OF THE PREFERRED EMBODIMENTS

Figure 11:
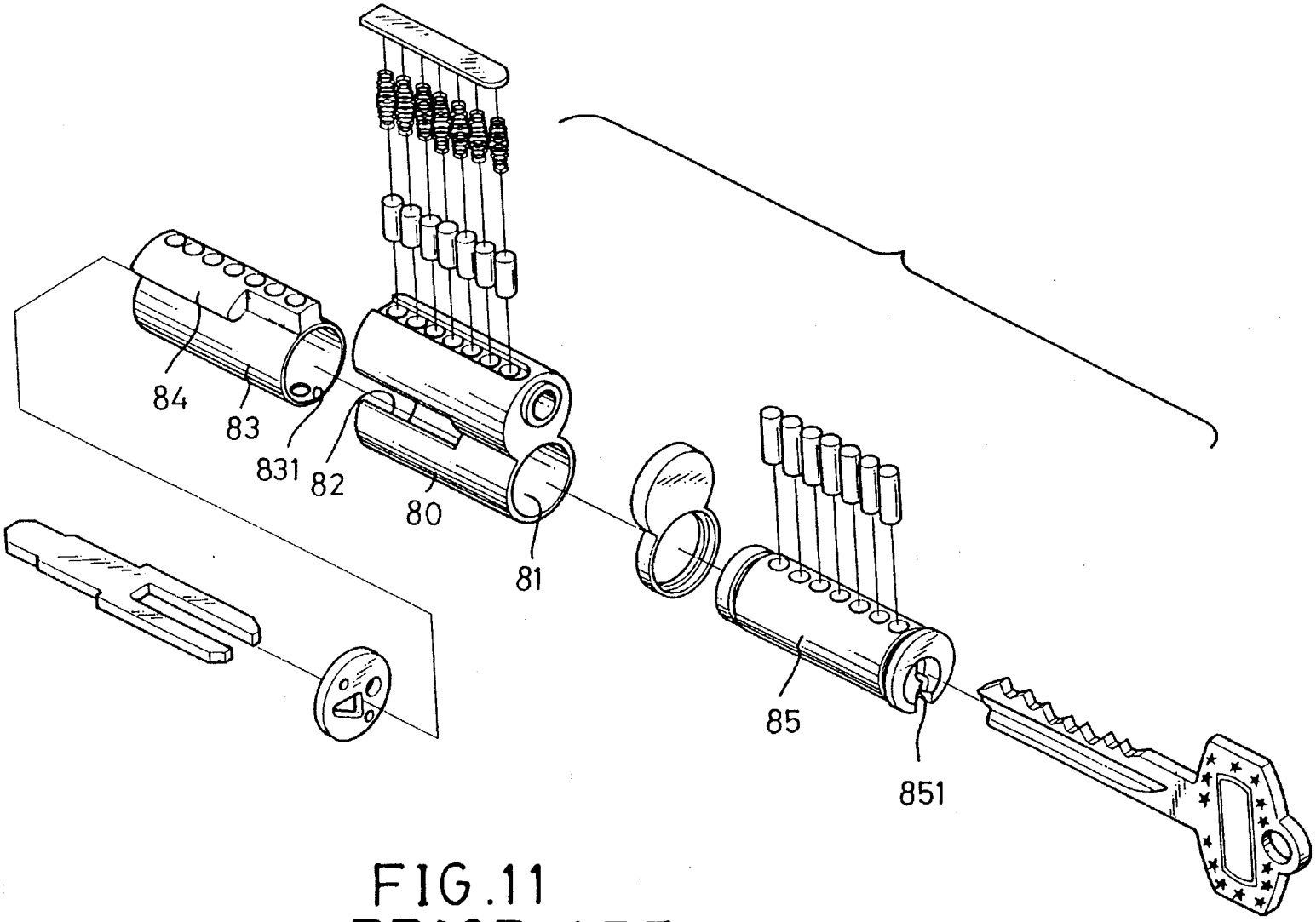
FIG.11 PRIOR ART
FIG. 11 is an exploded view of a conventional interchangeable lock core.
Figure 12:
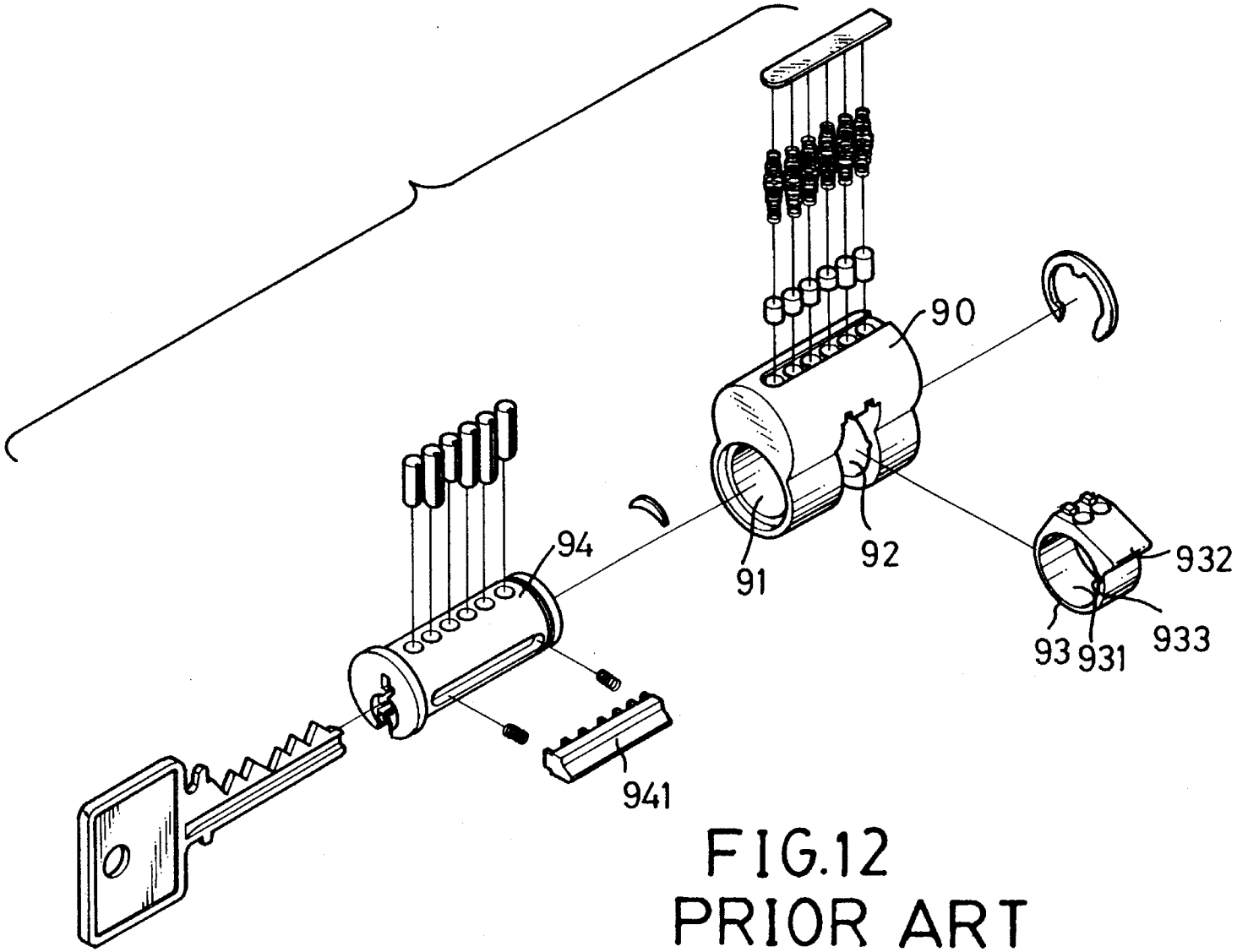
FIG.12 PRIOR ART
FIG. 12 is an exploded view of another conventional interchangeable lock core.

For a better understanding of the background of the invention, reference is firstly made to FIGS. 11 and 12 which show two typical prior art interchangeable lock cores. The interchangeable lock core shown in FIG. 11 has been sold for several decades and generally includes a main body 80, a hollow cylinder 83, and a cylindrical core body 85. The main body 80 is substantially "8" shaped in section and includes a bore 81 in a lower section thereof and a positioning slot 82 in a mediate section of a lateral side thereof. The hollow cylinder 83 is received in the bore 81 of the main body 80 and has a catch 84. The core body 85 has a keyway 851 therein and is received in a bore 831 of the hollow cylinder 83. It is appreciated that structure and operation of other elements, such as springs, drives, and tumblers illustrated in FIG. 11 are conventional and therefore are not specifically described herein. For normal operation of the lock, an operation key is inserted into the keyway 851 to unlock the lock in which the catch 84 remains in a position beyond the positioning slot 82. For changing the lock core, a control key is inserted into the keyway 851 and then is rotated through an angle such that the catch 84 is received in the positioning slot 82 and thus the whole core is removable from the lock housing. Such operations are conventional and will not be further described. In the above-mentioned structure, if any one of the main body 80, the hollow cylinder 83, and the core body 85 is not precisely machined, the core body 85 and the hollow cylinder 83 shall not be able to rotate smoothly. Thus, the three above-mentioned parts must be machined by specifically designed machines and molds and require precise machining which thus results in a high cost and troublesome operation during manufacture thereof.

Another conventional interchangeable lock core is shown in FIG. 12 which lock core includes a main body 90, a core body 94, and an operative ring 93. The main body 90 is also "8" shaped in section and includes a bore 91 in a lower section thereof and is cut at a mediate section of the lower section thereof to form a reception hole 92 for fittingly receiving the operative ring 93 which, in turn, has a bore 931 through which the core body 94 passes and a catch 932 which operates in a manner identical to the above-mentioned catch 84 and thus is not redundantly described. The core body 94 has a block 941 attached thereto by which block 941 abuts against a recess 933 in an inner periphery of bore 931 and urges the catch 932 to project beyond an outer periphery of the main body 90. Such a design may avoid the problem of precisely controlling the machining encountered in the above-mentioned conventional lock core design, yet there are too many elements in this design and the processing of the operative ring 93 and associated block 941 is complicated. A further drawback of this design is that no positioning member is provided such that the user does not know how many degrees should he/she rotate the control key through when he/she intends to change the lock core.

The present invention is intended to provide an improved design in the interchangeable lock cores to mitigate and/or obviate the above-mentioned drawbacks and problems.

Figure 1:
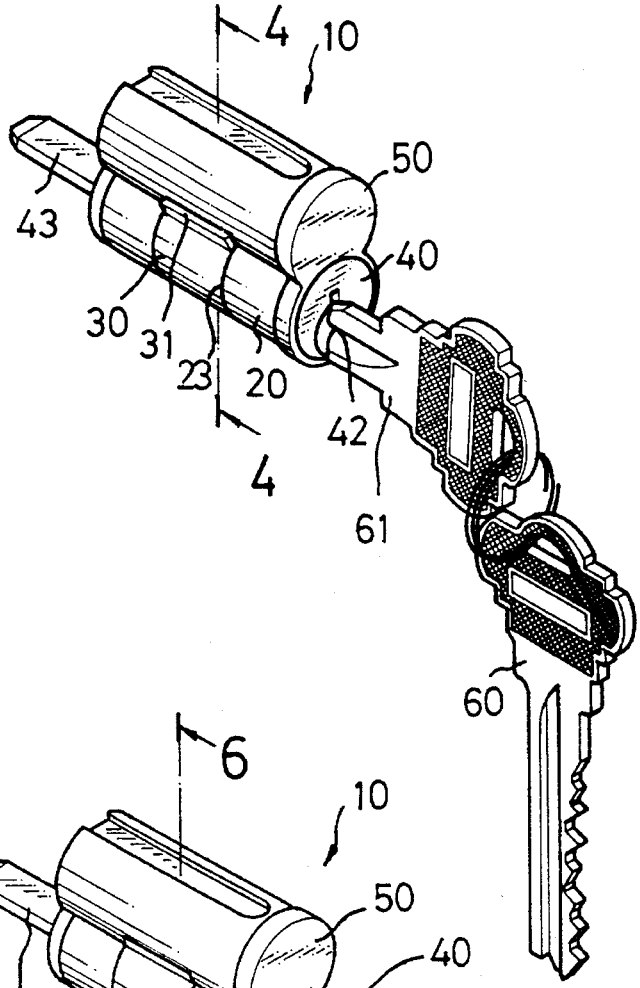
FIG. 1 is a perspective view of an interchangeable lock core in accordance with the present invention and an operation key as well as a control key therefor.
Figure 5:
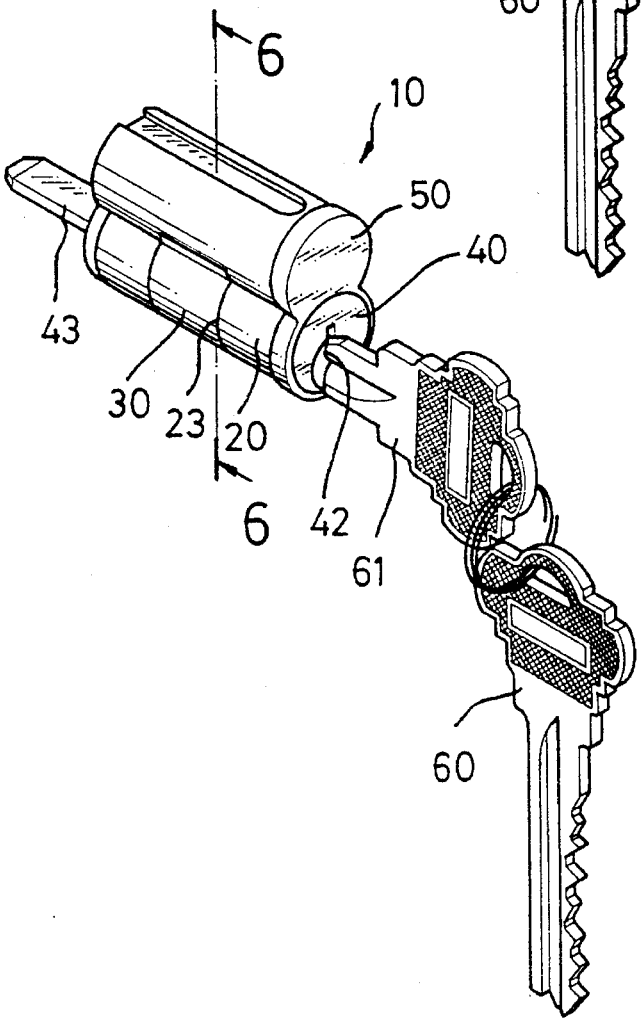
FIG. 5 is a perspective view similar to FIG. 1, wherein in which the lock core is readily mountable to a lock housing or removed therefrom.
Figure 2:
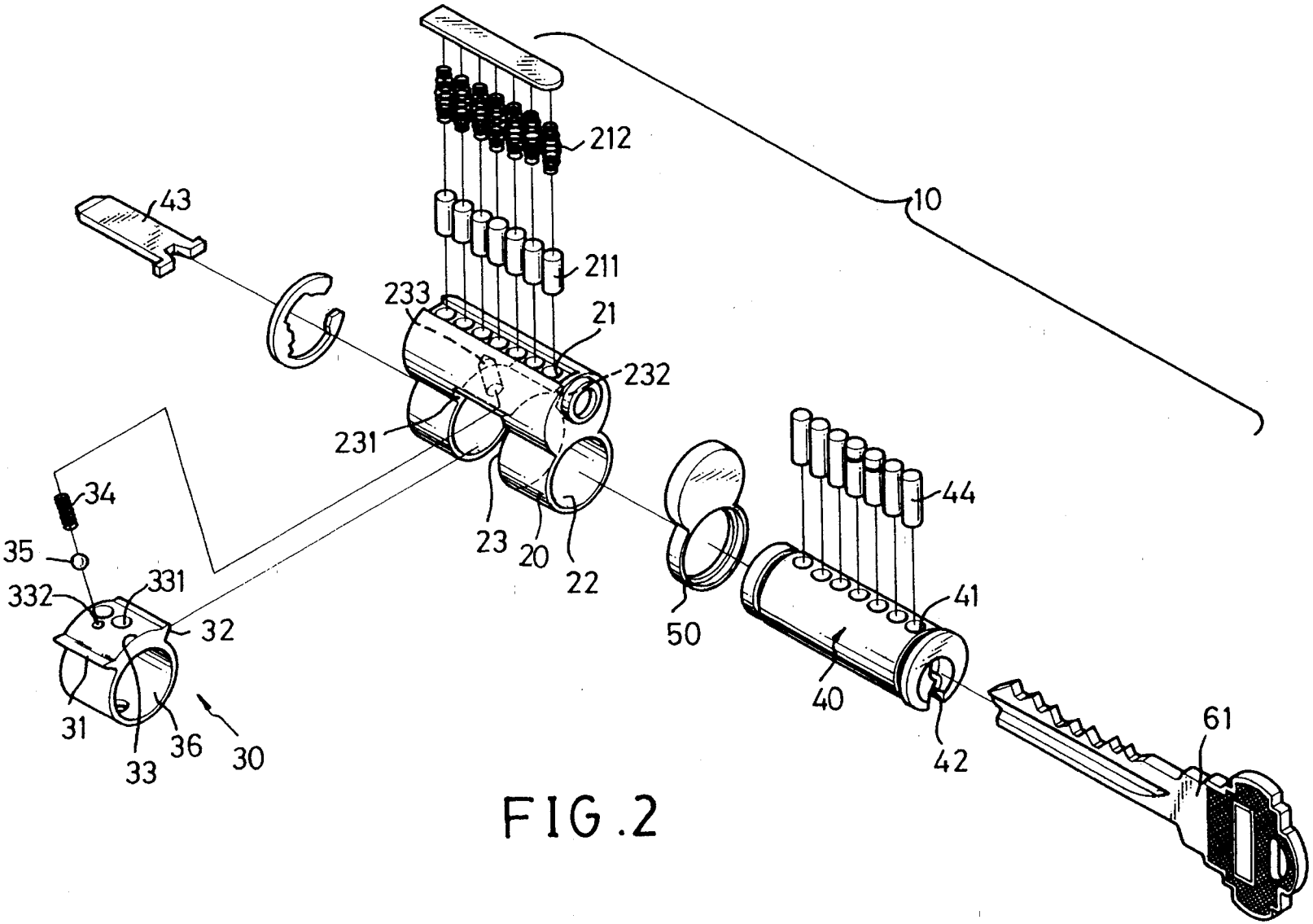
FIG. 2 is an exploded view of the interchangeable lock core and the control key.

Referring now to FIGS. 1 through 10 and initially to FIGS. 1 and 2, an interchangeable lock core in accordance with the present invention is designated by reference numeral "10" and includes a main body 20, an operative ring 30, and a core body 40. The main body 20 is integrally formed and is substantially "8" shaped in section, the upper section of which has a plurality of first holes 21 each for receiving a driver 211 and a spring 212 therein and the lower section of which has a bore 22 extending in a longitudinal axis thereof and a transverse reception hole 23 in a mediate section thereof. The reception hole 23 extends upwardly into the upper section of the main body 20 and defines first and second bevel operative edges 231 and 232 respectively at two sides of the upper section (see FIG. 4). A blind hole 233 is defined in the upper section of the main body 20 and communicates with the reception hole 23.

The operative ring 30 is also integrally formed and includes a bore 36 and an extension 33 projecting outwardly from an outer periphery thereof and extending along an arc thereof. The extension 33 has first and second catches 31 and 32 respectively at two sides thereof, one or more second holes 331 which communicate with bore 36, and a dimple 332 defined in an upper face thereof for cooperation with the blind hole 233 operation of which will be described hereinafter.

In assembly, a spring 34 and a ball 35 are firstly inserted into the blind hole 233 in sequence and then the operative ring 30 is inserted into the reception hole 23 with the ball 35 partially resting in the dimple 332 under the action of spring force. Thereafter, the core body 40, after passing through a bore (not labeled) of a substantially "8" shaped cap 50 securely mounted to an end of the main body 20, is inserted into bore 22 in the lower section of the main body 20 and bore 36 in the operative ring 30, such that each of the first holes 21 aligns with an associated third hole 41 in the core body 40 and that the two second holes 331 align with associated first and third holes 21 and 41, while each driver 211 enters an associated third hole 41 which has already received a tumbler 44 therein.

Figure 3:
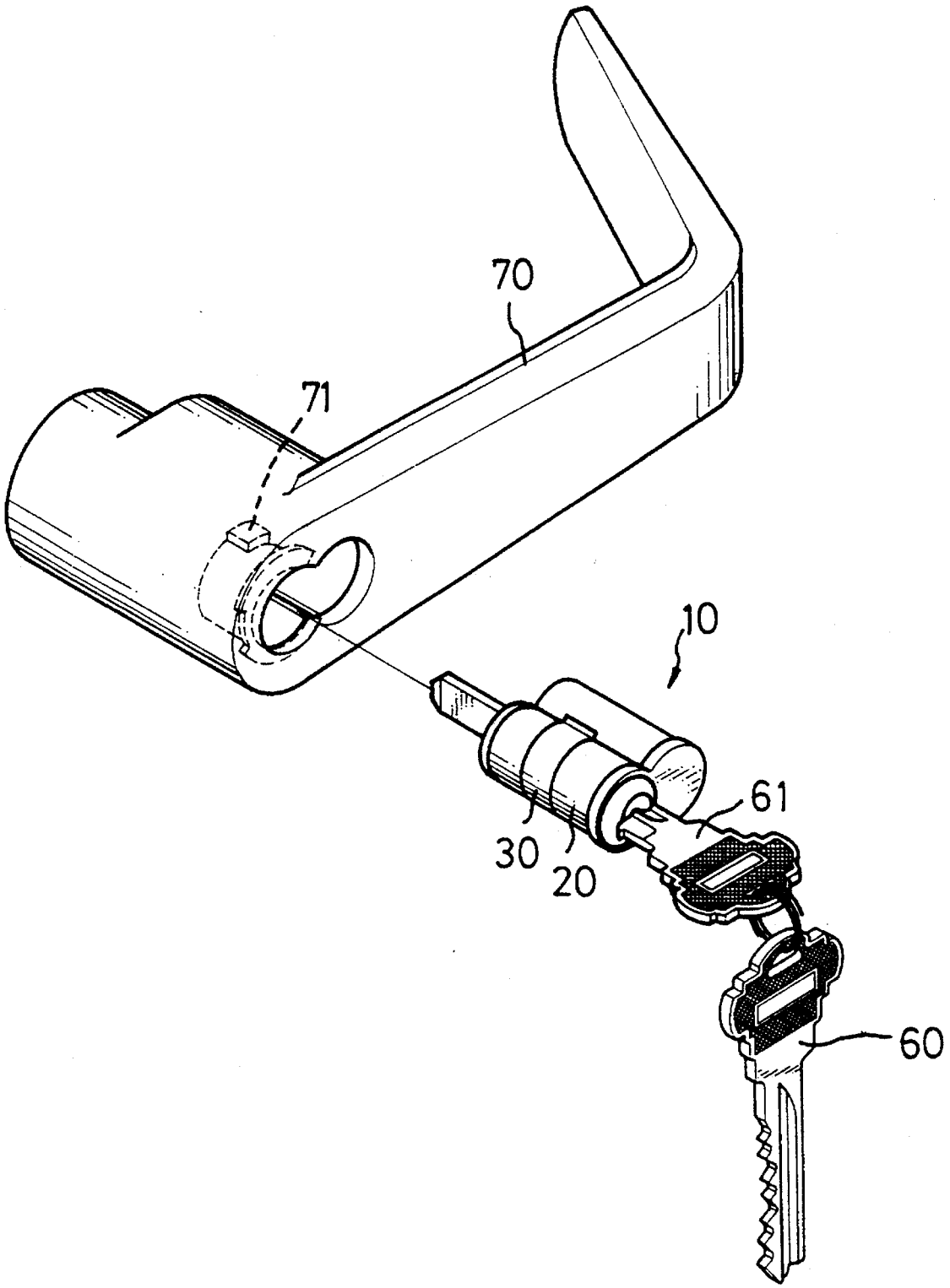
FIG. 3 is a perspective view illustrating installation of the lock core into an exterior lock housing.
Figure 4:
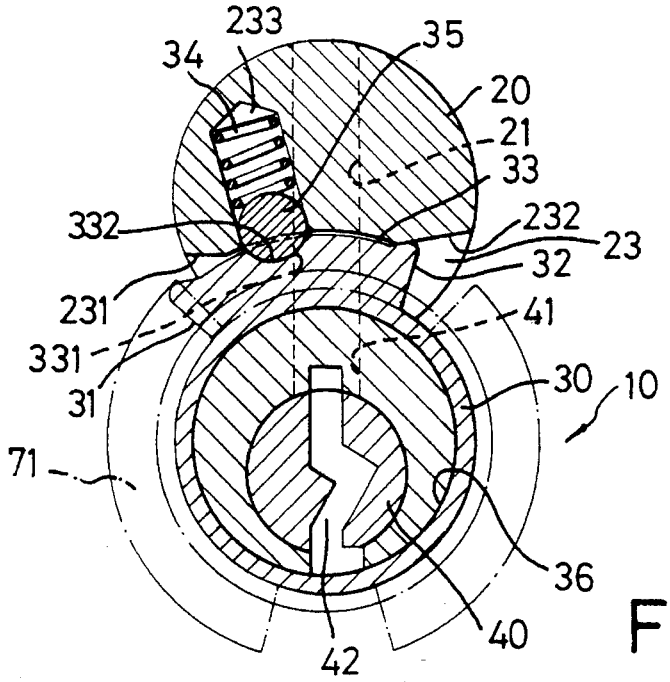
FIG. 4 is a cross-sectional view taken along line 4—4 in FIG. 1, the key being omitted for clarity and a retainer being added in phantom lines for illustration purpose.

The assembled lock core 10 can be installed into an exterior lock housing with an operative handle 70 by means of a control key 61, as shown in FIG. 3. Referring now to FIGS. 1 and 4 in which the first catch 31 is in a position beyond the main body 10 and the second catch 32 bears against the second bevel operative edge 232, the ball 35 is partially received in the dimple 332, and the first, second, and third holes 21, 331, and 41 are in an aligned manner. For installation of the lock core 10 into the exterior lock housing, a control key 61 is inserted into a keyway 42 in the core body 40 and then is e.g., clockwise rotated through a small angle until the first catch 31 is received in the main body 20 and bears against the first bevel operative edge 231 while the second catch 32 disengages with the second bevel operative edge 232 and the ball 35 is moved upwardly and thus completely received in the blind hole 233 (see FIGS. 5 and 6). After mounting the lock core 10 into the lock housing, the control key 61 is rotated counterclockwise such that the lock core 10 is returned to a status shown in FIG. 4 such that the lock core 10 is retained by a retainer 71 which is mounted in the exterior lock housing for positioning the lock core 10 during normal locking/unlocking operation of the lock.

Figure 7:
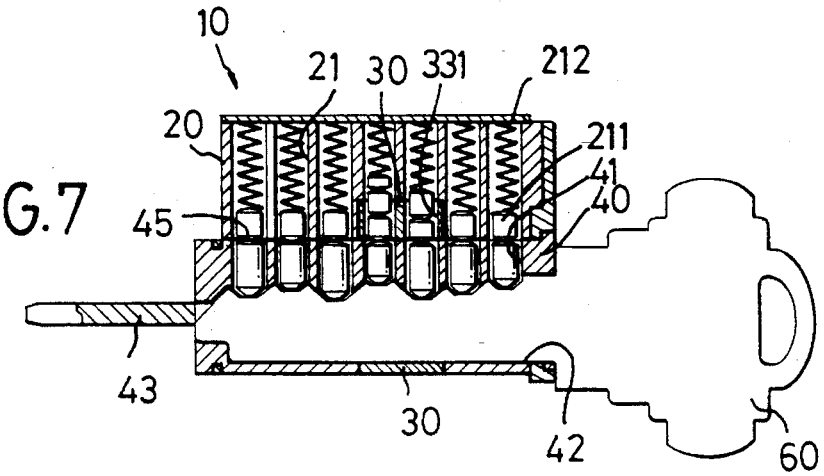
FIG. 7 is a longitudinal partial cross-sectional view of the lock core with an operation key inserted therein.

Now the lock core 10 is retained in position and the user may use the operation key 60 for unlocking the lock. Referring to FIG. 7, when the operation key 60 is inserted into the keyway 42, the tumblers 44 are moved axially until the tops of the tumblers 44 are aligned along a shear line 45. Rotation of the operation key 60 actuates a tailpiece 43 to cause the lock to be in an unlocked position, operation of which is conventional and therefore is not further described.

During a change of locking and unlocking positions of the operative ring 30 as shown in FIGS. 4 and 6 respectively, it can be seen that there is always a curved, concave-convex matching relationship along a control shear line between the main body 20 and the operative ring 30. This concave-convex matching relationship holds true for both opposite adjacent sides of the first hole 21, because there is a sufficiently wide, curved face between the edges 231 and 232 to matchingly cooperate with the upper surface of the extension 33.

Figure 8:
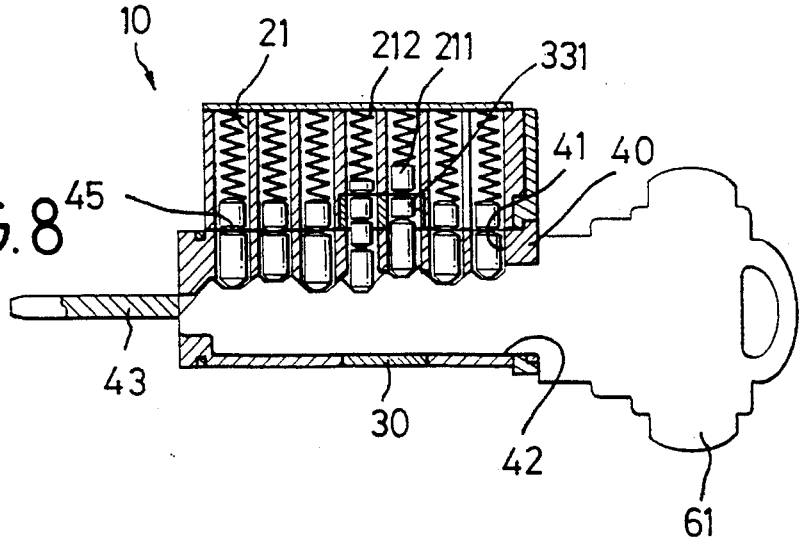
FIG. 8 is a longitudinal partial cross-sectional view of the lock core with a control key inserted therein.

For interchanging the lock core 10, referring to FIG. 8, when a control key 61 is inserted into the keyway 42, there are two tumblers 44 not aligned along the shear line 45 as the control key 61 has a configuration in the blade portion different from that in the blade portion of the operation key 60. Then, the control key 61 is rotated clockwise through an angle to a status shown in FIG. 6 in which position the lock core 10 is no longer retained by the retainer 71 such that the whole lock core 10 may be removed (see FIG. 5) and replaced with a new one in a manner described hereinbefore to prevent unauthorized entrance.

FIGS. 9 and 10 illustrate another working embodiment of the invention in which the lock core 10 cooperates with a dual function key, i.e., the key 62 may serve either as an operation key when it is completely inserted into the keyway 42 (see FIG. 9) or as a control key when it is partially inserted into the keyway 42 (see FIG. 10) which is conventional and will not be further described.

According to the above, it is appreciated that the present invention has successfully avoided the disadvantages encountered in the prior art lock cores. For example, the provision of the ball 35, the spring 34, and the dimple 332 provides a reliable positioning effect and allows the user to easily pull out the key. Furthermore, the operative ring 30 is improved such that the block 941 and the recess 933 in the second-mentioned prior art lock core are eliminated, thereby providing a simplified structure which can be machined more easily when compared with the first-mentioned prior art lock core.

Although the invention has been explained in relation to its preferred embodiment, it is to be understood that many other possible modifications and variations can be made without departing from the spirit and scope of the invention as hereinafter claimed.

I claim:

1. An interchangeable lock core comprising:

(a) a main body made of a single piece and comprising upper and lower sections, said upper section having two sides and a plurality of first holes each for receiving a driver and a spring therein, said lower section having a first bore extending in a longitudinal axis thereof and a transverse reception hole in a mediate section thereof, said reception hole extending upwardly into said upper section and defining first and second operative edges respectively at said sides of said upper section, a blind hole being defined in said upper section and communicating with said reception hole, a second spring and a ball being received in said blind hole;

(b) an operative ring received in said reception hole of said lower section of said main body and comprising a second bore in alignment with said first bore and an extension which projects outwardly from an outer periphery thereof and extends along an arc thereof, said extension having first and second catches respectively at two sides thereof, at least one second hole being defined in said extension of said ring, aligning with associated said first hole in said upper section of said main body, and communicating with said second bore of said ring, said extension further having a dimple defined in an upper face thereof; and (c) a core body received in said first bore of said main body and said second bore of said operative ring and comprising a keyway and a plurality of third holes each aligning with associated said first hole;

whereby when a control key is inserted into said keyway, said operative ring being pivotable between (i) a first position in which said second catch bears against said second operative edge and said first catch is in a position beyond said main body for locking/unlocking operation under operation of an operation key when said lock core is mounted in an exterior lock housing and (ii) a second position in which said first catch is in a position in said reception hole such that said lock core is mountable to the exterior lock housing or removable therefrom, the improvement comprising:

said main body having a wide, curved face being provided between said first and second operative edges to matchingly cooperate with an upper surface of said extension, and said curved face being sufficiently wide to maintain a concave-convex matching relationship along a control shear line between said main body and said operative ring for both opposite adjacent sides of said first holes, irrespective of whether said operative ring is in said first or second position, and said ball being partially received in said dimple to accurately position said operative ring with respect to said main body when said operative ring is in said first position, and said ball disengaging from said reception hole when said operative ring is in said second position.

* * * * *